US008621860B2

(12) United States Patent
Hennemann et al.

(10) Patent No.: US 8,621,860 B2
(45) Date of Patent: Jan. 7, 2014

(54) CONTROL SYSTEM FOR WORK VEHICLE

(75) Inventors: Matthew J. Hennemann, Burlington, IA (US); C. David Anderson, Burlington, IA (US); Garrett L. Anderson, Seguin, TX (US)

(73) Assignee: CNH America LLC, New Holland, PA (US)

( * ) Notice: Subject to any disclaimer, the term of this patent is extended or adjusted under 35 U.S.C. 154(b) by 698 days.

(21) Appl. No.: 12/909,911

(22) Filed: Oct. 22, 2010

(65) Prior Publication Data

US 2012/0097277 A1 Apr. 26, 2012

(51) Int. Cl.
*F16D 31/02* (2006.01)

(52) U.S. Cl.
USPC ..... 60/484; 60/325

(58) Field of Classification Search
USPC ..... 60/327, 420, 422, 445, 459, 462, 464, 60/465, 368, 423, 431, 484, 325
See application file for complete search history.

(56) References Cited

U.S. PATENT DOCUMENTS

| | | | |
|---|---|---|---|
| 3,395,732 A | 8/1968 | Comfort | |
| 4,215,622 A | 8/1980 | Chichester | |
| 4,523,886 A | 6/1985 | Reeves | |
| 6,202,014 B1 | 3/2001 | Brandt et al. | |
| 6,311,489 B1 | 11/2001 | Stangl et al. | |
| 6,923,285 B1 | 8/2005 | Rossow et al. | |
| 2009/0159143 A1 | 6/2009 | Nishikawa et al. | |
| 2010/0275589 A1 * | 11/2010 | Meyers et al. | 60/327 |

FOREIGN PATENT DOCUMENTS

| | | |
|---|---|---|
| JP | 361113932 A | 5/1986 |
| JP | 402171428 A | 7/1990 |
| JP | 02002227233 A | 8/2002 |

* cited by examiner

*Primary Examiner* — Edward Look
*Assistant Examiner* — Logan Kraft
(74) *Attorney, Agent, or Firm* — Patrick M. Sheldrake

(57) ABSTRACT

A work machine includes a fluid circuit for use with an attachment configured to operate using one of a uni-directional flow and a bi-directional flow through the attachment. An operator-enabled mode selection switch operably connects to a controller. An electrical circuit includes the operator-enabled mode selection switch and a second operator-enabled switch. A first control valve is in fluid communication with the attachment. In response to the mode selection switch being operator-actuated to a bi-directional mode setting, the first control valve via the controller is actuatable to one of the bi-directional positions, electrical power being unavailable to the second operator-enabled switch of the electrical circuit. In response to the mode selection switch being operator-actuated to a uni-directional mode setting, the first control valve via the controller secures the first control valve in the uni-directional position, and electrical power is provided to the second operator-enabled switch of the electrical circuit.

13 Claims, 3 Drawing Sheets

CONTROL SYSTEM FOR WORK VEHICLE

FIELD OF THE INVENTION

The present invention relates generally to the field of work vehicles. It relates more particularly to work vehicles having a fluid system for manipulating attachments.

BACKGROUND OF THE INVENTION

Work vehicles, such as a loader backhoe, also referred to as a backhoe, are versatile machines that are commonly used on job sites. A wide arrangement of attachments that operate using the pressurized fluid systems such as thumbs, hammers, compactors, brooms, planers, augers, etc., contribute to the versatility of the work vehicle. While a number of the attachments are configured to operate using uni-directional fluid flow (one flow direction; having dedicated pressure and return line), others are configured to operate using bi-directional fluid flow (reversible flow direction; i.e., forward and reverse).

It is desirable to have the capability to run both uni-directional and bi-directional attachments on the same work vehicle. That is, the work vehicle would have a uni-directional mode to operate uni-directional attachments, as well as a bi-directional mode to operate bi-directional attachments. To accommodate both attachments, albeit one attachment at a time, a number of manufacturers run four (4) hoses/tubes through the boom to power the attachments. However, the use of four hoses/tubes increases cost, as well as the opportunity for damage to the hoses during normal use and hoses extending exterior of the machine structure may also reduce visibility to the working area of the machine, even when no attachments are in use.

In addition, mindful that users may wish to switch between uni-directional and bi-directional attachments, protections must be provided in case a bi-directional attachment is utilized when the work vehicle is configured to operate in a uni-directional mode, possibly causing damage to the bi-directional attachment.

Accordingly, it would be advantageous to prevent inadvertent damage to a bi-directional attachment when the work vehicle is configured to operate in a uni-directional mode, while also avoiding other disadvantages of the known art.

SUMMARY OF THE INVENTION

The present invention relates to a work machine including a fluid circuit for use with an attachment configured to operate using one of a uni-directional flow and a bi-directional flow through the attachment. The circuit includes an operator-enabled mode selection switch operably connected to a controller. An electrical circuit includes the operator-enabled mode selection switch and a second operator-enabled switch. A first control valve is in fluid communication with the attachment, the first control valve including a first bi-directional position, a uni-directional position and a second bi-directional position. In response to the mode selection switch being actuated to a bi-directional mode setting by the operator, the first control valve via the controller, is actuatable by the operator to one of the bi-directional positions, and electrical power is unavailable to the second operator-enabled switch of the electrical circuit. In response to the mode selection switch being actuated to a uni-directional mode setting by the operator, the first control valve via the controller, secures the first control valve in the uni-directional position, and electrical power is provided to the second operator-enabled switch of the electrical circuit.

The present invention further relates to a work machine including a fluid circuit for use with an attachment configured to operate using one of a uni-directional flow and a bi-directional flow through the attachment. The fluid circuit includes an operator-enabled mode selection switch operably connected to a controller. An electrical circuit includes the operator-enabled mode selection switch and a second operator-enabled switch. A first control valve is in fluid communication with the attachment, the first control valve comprising a first bi-directional position, a uni-directional position and a second bi-directional position. The first control valve includes a solenoid to selectively secure the control valve in the uni-directional position. In response to the mode selection switch being actuated to a bi-directional mode setting by the operator, the first control valve via the controller, is actuatable by the operator to one of the bi-directional positions, and electrical power is unavailable to the second operator-enabled switch of the electrical circuit. In response to the mode selection switch being actuated to a uni-directional mode setting by the operator, the first control valve via the controller, secures the first control valve in the uni-directional position, and electrical power is provided to the second operator-enabled switch of the electrical circuit.

An advantage of the present invention is enhanced protection for uni-directional and bi-directional attachments for use with the work vehicles.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
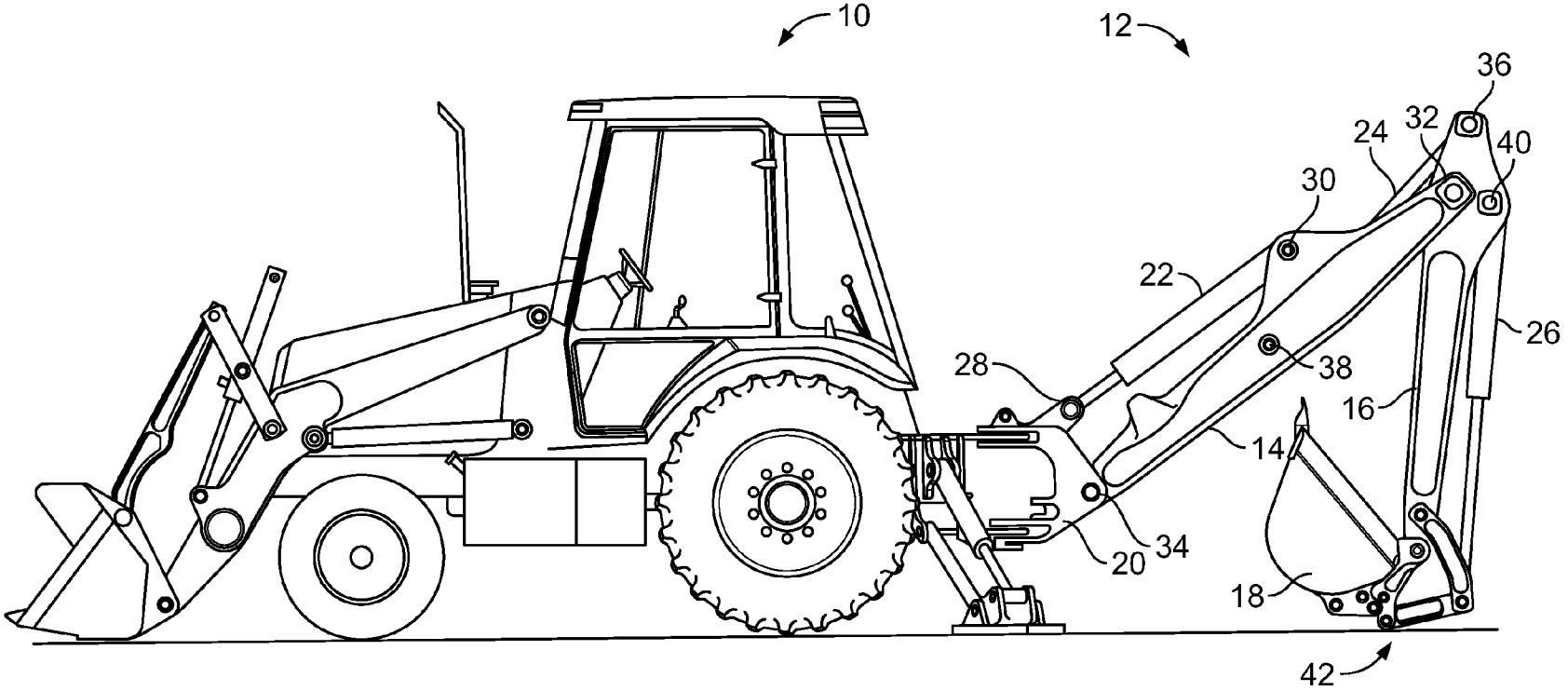
FIG. 1 shows a top perspective view of an embodiment of a work machine of the present invention.

Referring to the drawings for a description of an earth-working machine 10 that employs the present invention, FIG. 1 shows a boom 14 in a lowered position. Boom 14 pivots about a pivot joint 34 and coincident pivot axis of a frame 20 and is controlled by extension/contraction of a fluid ram 22 connected between pivot joints 28, 30. Similarly, an arm 16, often referred to as a dipper, pivots about pivot joint 32 of boom 14 and is controlled by extension/contraction of fluid ram 24 connected between pivot joints 36, 38. In addition, implement or attachment 18, such as a bucket, is pivotably connected to arm 16 and is controlled by extension/contraction of a fluid ram 26 connected between pivot joint 40 and interconnected linkages 42. A backhoe 12 comprises the combination of boom 14, arm 16, implement 18 and pivoting connections therebetween.

The present disclosure is directed to attachments that operate using a fluid circuit of a pressurized fluid system of the machine, such as thumbs, hammers, compactors, brooms, planers, augers, etc., which attachments are configured to operate using uni-directional fluid flow or bi-directional fluid flow. The present disclosure is further directed to preventing damage to these attachments in case the operator selects an incorrect mode of operation. That is, for example, configuring the machine to operate with a uni-directional attachment, when in fact, a bi-directional attachment is utilized. In such a circumstance, the attachment may be damaged by providing a greater pressure to the return line of the attachment than the attachment is designed to handle, sometimes referred to as "backflowing" the attachment.

Figure 2:
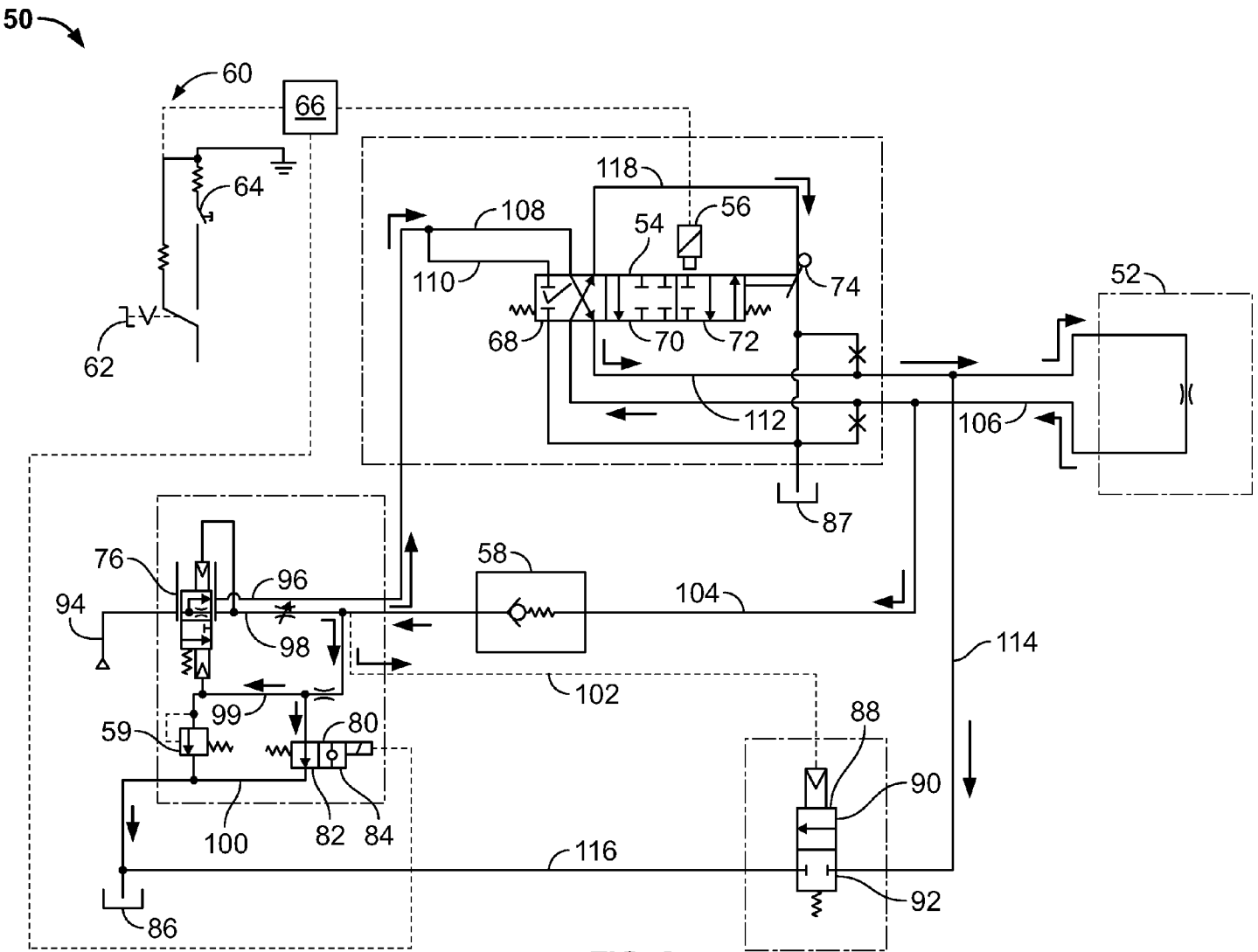
FIGS. 2 and 3 show schematics of a fluid system of the present invention.

FIG. 2 shows a fluid circuit 50 configured for operation with a bi-directional attachment 52, including an electrical circuit 60. In the bi-directional mode, an operator-enabled mode selection switch 62 is actuated to a bi-directional mode setting. In response to the operator selecting the bi-directional mode setting, electrical power is removed or is otherwise unavailable to a second operator-enabled switch 64. That is, second operator-enabled switch 64, which selectively provides pressurized fluid to attachment 52 when electrical power from electrical circuit 60 is provided to the switch, is disabled. Also in response to the operator selecting the bi-directional mode setting, a control valve 80 having an open position 82 and a closed position 84 is actuated to its open position 82, such as by a controller 66. By virtue of control valve 80 being maintained in open position 82, lines 98, 99 are maintained in fluid communication with line 100 which is in fluid communication with a reservoir 86. Line 98 is in fluid communication with a line 102 that is connected to a control valve 88 having an open position 90 and a closed position 92. In response to the low fluid pressure level maintained in line 98, control valve 88 is urged to closed position 92. As further shown in FIG. 2, pressurized fluid from a pressurized fluid source (not shown), enters a variable flow control valve 76 via line 94. Fluid having a raised pressure level is directed from control valve 76 via line 96, which line 96 bifurcates into lines 108, 110 that lead to a first control valve 54.

As shown in FIG. 2, first control valve 54 includes a first bi-directional position 68, a uni-directional position 70, and a second bi-directional position 72 In response to the operator selectably placing operator-enabled mode selection switch 62 in the bi-directional setting position, controller 66, which controls solenoid 56 of first control valve 54, urges solenoid 56 to disengage position control of the first control valve, permitting operator control of the position of the first control valve by an operator-controlled lever 74, such as between first bi-directional position 68 and second bi-directional position 72. As further shown in FIG. 2, first control valve 54 has been placed in first bi-directional position 68, so that pressurized fluid in line 108 flows through first control valve 54, through line 112, providing fluid power to attachment 52. On the return side from attachment 52, line 106 is in fluid communication with first control valve 54 and with line 118, emptying into reservoir 87.

Figure 3:
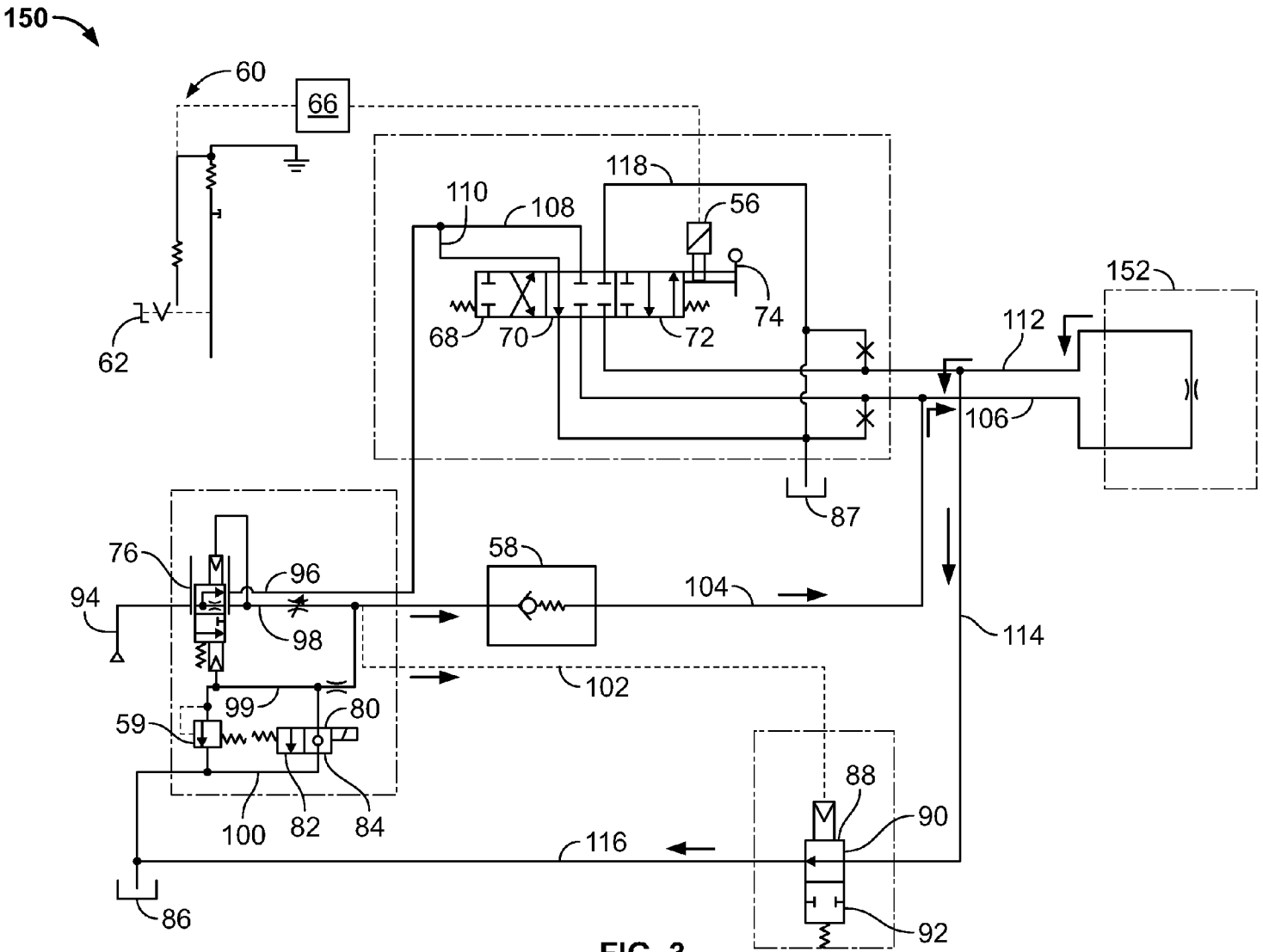

FIG. 3 shows fluid circuit 150, similar to fluid circuit 50, configured for operation with a uni-directional attachment 152, including an electrical circuit 60. In the uni-directional mode, operator-enabled mode selection switch 62 is actuated to a uni-directional mode setting. In response to the operator selecting the uni-directional mode setting, electrical power is provided to second operator-enabled switch 64. That is, second operator-enabled switch 64, which selectively provides pressurized fluid to attachment 152 when electrical power from electrical circuit 60 is provided to the switch, is enabled. Also in response to the operator selecting the uni-directional mode setting, control valve 80 is actuated to its closed position 84, such as by controller 66. By virtue of control valve 80 being maintained in closed position 84 in fluid communication with a relief valve 59, the fluid pressure level is maintained at a raised pressure in lines 98, 99. Line 98 is in fluid communication with a line 102 that is connected to a control valve 88. In response to the raised fluid pressure level maintained in line 98, control valve 88 is urged to open position 90. As further shown in FIG. 3, pressurized fluid from a pressurized fluid source (not shown), enters a variable flow control valve 76 via line 94. Fluid having a raised pressure level is directed from control valve 76 via line 98, which raised pressure level opens a check valve 58, and flowing via lines 104 and 106 to attachment 152, providing fluid power to the attachment 152.

As further shown in FIG. 3, in response to the operator selectably placing operator-enabled mode selection switch 62 in the uni-directional setting position, controller 66, which controls solenoid 56 of first control valve 54, urges solenoid 56 to engage position control of the first control valve in uni-directional position 70, disabling operator control of the position of the first control valve by an operator-controlled lever 74. On the return side from attachment 152, line 112 is in fluid communication with line 118 that is in fluid communication with first control valve 54, but flow through the first control valve via lines 112, 118 is prevented in the uni-directional position 70. Fluid flow from the return side of attachment 152 via line 112 may return to reservoir 87. Alternately, due to control valve 88 being maintained in open position 90, fluid from the return side of attachment 152 via line 112 may flow through line 114, then through control valve 88, before emptying into reservoir 86 via line 116.

It is to be understood that the fluid circuit of the present disclosure may be used with either at an open-center hydraulic system, in which the control valves are positioned in series in the fluid circuit, or a closed-center hydraulic system, in which the control valves are positioned in parallel in the fluid circuit.

In an alternate embodiment, an electro-hydraulic control system may be utilized instead of a spool lock solenoid as described above in the exemplary embodiment described above. In an electro-hydraulic control system, power may be provided when the operator-enabled mode switch is set to bi-directional mode, and not provided when the mode switch is set to uni-directional mode. Alternately, a hydraulic pilot system may be employed. For example, control valve 88 may be a pilot operated check valve or a non-proportional solenoid operated valve.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A work machine comprising:

a fluid circuit for use with an attachment configured to operate using one of a uni-directional flow and a bi-directional flow through the attachment;

the fluid circuit including an operator-enabled mode selection switch operably connected to a controller;

an electrical circuit comprising the operator-enabled mode selection switch and a second operator-enabled switch; and a first control valve in fluid communication with the attachment, the first control valve comprising a first bi-directional position, a uni-directional position and a second bi-directional position;

in response to the mode selection switch being actuated to a bi-directional mode setting by the operator, the first control valve via the controller, is actuatable by the operator to one of the bi-directional positions, and electrical power is unavailable to the second operator-enabled switch of the electrical circuit;

in response to the mode selection switch being actuated to a uni-directional mode setting by the operator, the first control valve via the controller, secures the first control valve in the uni-directional position, and electrical power is provided to the second operator-enabled switch of the electrical circuit.

2. The work machine of claim 1, wherein the mode selection switch is actuated by the operator to a bi-directional mode setting in response to a bi-directional attachment being placed in fluid communication with the fluid circuit.

3. The work machine of claim 1, wherein the mode selection switch is actuated by the operator to a uni-directional mode setting in response to a uni-directional attachment being placed in fluid communication with the fluid circuit.

4. The work machine of claim 1, wherein the first control valve includes a solenoid to selectively secure the control valve in the uni-directional position.

5. The work machine of claim 1, wherein the fluid circuit is configured for use with an open-center hydraulic system.

6. The work machine of claim 5, comprising a second control valve upstream of the first control valve.

7. The work machine of claim 6, wherein the second control valve is a variable flow control valve.

8. The work machine of claim 1, wherein the fluid circuit is configured for use with an closed-center hydraulic system.

9. The work machine of claim 8, comprising a second control valve arranged in parallel with the first control valve in the fluid circuit.

10. The work machine of claim 9, wherein the second control valve is a variable flow control valve.

11. The work machine of claim 1, wherein the work machine is a loader backhoe.

12. A work machine comprising:

a fluid circuit for use with an attachment configured to operate using one of a uni-directional flow and a bi-directional flow through the attachment;

the fluid circuit including an operator-enabled mode selection switch operably connected to a controller;

an electrical circuit comprising the operator-enabled mode selection switch and a second operator-enabled switch; and a first control valve in fluid communication with the attachment, the first control valve comprising a first bi-directional position, a uni-directional position and a second bi-directional position, the first control valve including a solenoid to selectively secure the control valve in the uni-directional position;

in response to the mode selection switch being actuated to a bi-directional mode setting by the operator, the first control valve via the controller, is actuatable by the operator to one of the bi-directional positions, and electrical power is unavailable to the second operator-enabled switch of the electrical circuit;

in response to the mode selection switch being actuated to a uni-directional mode setting by the operator, the first control valve via the controller, secures the first control valve in the uni-directional position, and electrical power is provided to the second operator-enabled switch of the electrical circuit.

13. The work machine of claim 12, wherein the work machine is a loader backhoe.

* * * * *